United States Patent [19]

Viannay et al.

[11] 4,445,525

[45] May 1, 1984

[54] ARRANGEMENT OF THE INPUT AND OUTPUT ENDS OF A COOLING MACHINE FOR METAL SHEETS

[75] Inventors: Stéphane Viannay, Trappes; Alfred Germain, Dunkerque-Malo-Les-Bains; Jack Sebbah, Trith-Saint-Leger, all of France

[73] Assignee: Union Siderurgique du Nord et de l'Est de la France, Paris, France

[21] Appl. No.: 338,512

[22] Filed: Jan. 11, 1982

[30] Foreign Application Priority Data

Jan. 9, 1981 [FR] France ..... 81 00287

[51] Int. Cl.[3] ..... B08B 3/02

[52] U.S. Cl. ..... 134/122 R; 266/113

[58] Field of Search ..... 134/64 R, 64 P, 122 R, 134/122 P, 9, 15; 266/112, 113

[56] References Cited

U.S. PATENT DOCUMENTS 4,064,884 12/1977 Asp ..... 134/64 R X
4,185,648 1/1980 Germain ..... 134/122 R

FOREIGN PATENT DOCUMENTS 2223096 10/1974 France .
2413139 7/1979 France .
2413140 7/1979 France .
2413141 7/1979 France .
2413467 7/1979 France .

*Primary Examiner*—Robert L. Bleutge
*Attorney, Agent, or Firm*—Cushman, Darby & Cushman

[57] ABSTRACT

The arrangement is provided in order to limit or prevent leakages of cooling liquid which always occur under various circumstances at the ends of the machine. The arrangement is provided at the input and output ends of the machine for cooling metal sheets or the like, which is of the type comprising an upper frame and a lower frame. Each frame comprises two lateral walls interconnected by a case which defines an enclosure in which the cooling liquid circulates. The arrangement resides in the fact that there are provided, at each of said ends, on one hand, a sump for collecting the cooling liquid and carried by the lower frame and extending throughout the width of the machine and, on the other hand, a device carried by the upper frame and adapted to project toward the interior of the machine a jet of fluid which is directed in counter-current fashion against the cooling liquid which tends to issue from the machine.

8 Claims, 2 Drawing Figures

FIG. 1
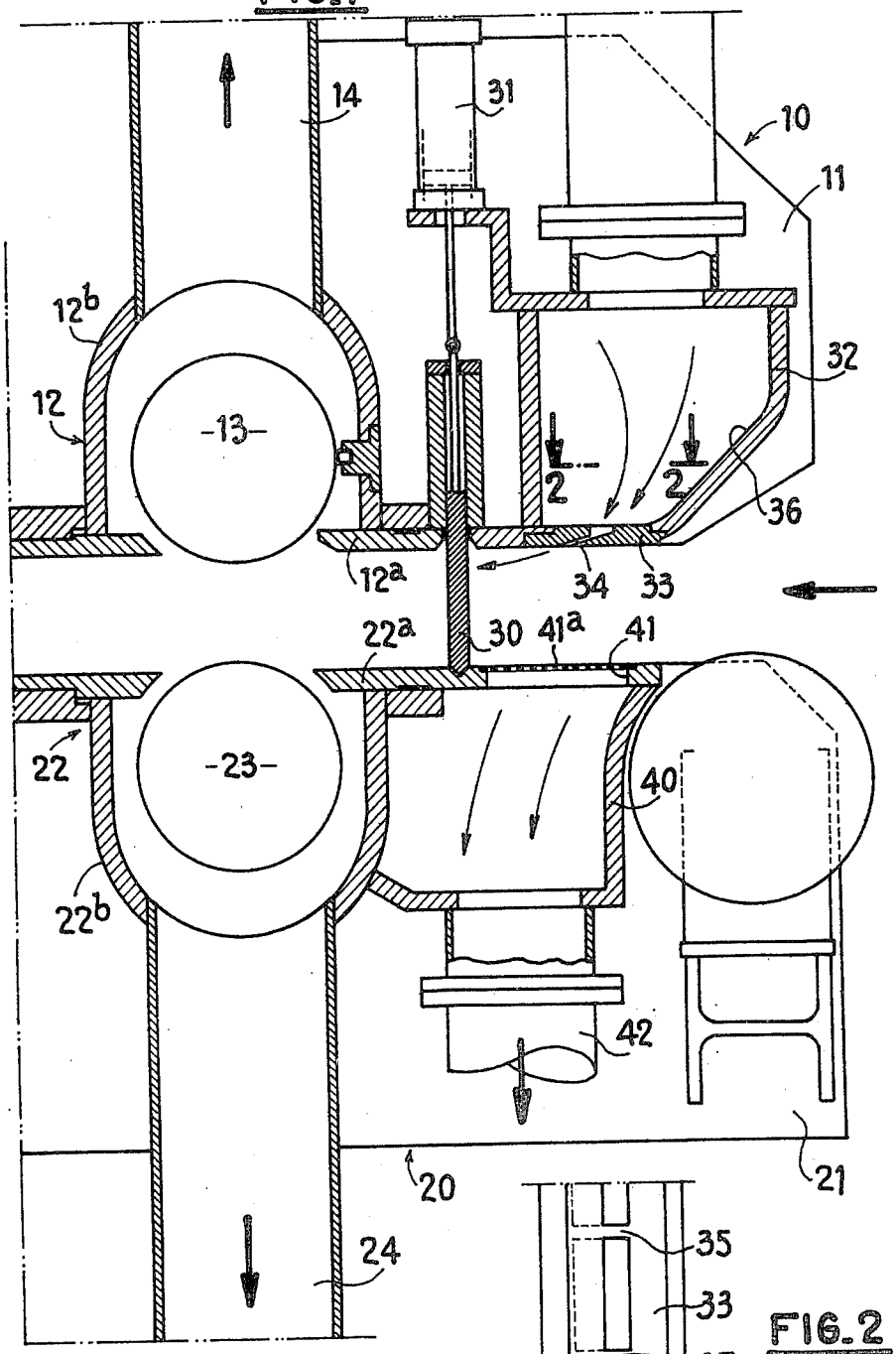
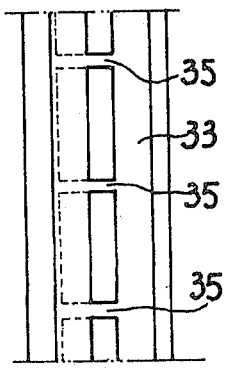
FIG. 2

ARRANGEMENT OF THE INPUT AND OUTPUT ENDS OF A COOLING MACHINE FOR METAL SHEETS

DESCRIPTION

The present invention relates to machines for treating and in particular cooling metal sheets or like products, of the type comprising a lower frame and an upper frame in which are mounted sets of rolls for driving and guiding the metal sheet and operating in pairs, the two frames defining therebetween an enclosure in which a treating fluid circulates. Such a machine is described in particular in French patent application No. 73 10710 filed Mar. 26, 1973 and published Oct. 25, 1974 as U.S. Pat. No. 2,223,096 and in the French application Nos. 77 39833, 77 39834, 77 39835, 77 39836 filed on Dec. 30, 1977 and published July 27, 1979 as U.S. Pat. Nos. 2,413,139; 2,413,140; 2,413,141 and 2,413,467, respectively.

In such a machine, it is desirable to limit or avoid leakage or leakages of cooling liquid which do not fail to occur under various circumstances at the ends of the machine. In particular, residual leakages occur even when the machine is completely closed. Larger leakages occur also when the input and output flaps are opened immediately before the entry of the sheet in the machine and immediately before the exit of the sheet. Further, while the sheet passes through the machine, leakages occur mainly above the sheet and on each side of the latter.

It is important to be in a position to prevent such leakages, on one hand, so that the immediate vicinity of the machine remains as dry as possible and, on the other hand, in order to ensure that the presence of a certain amount of water on the upper surface of the sheet does not result in a thermal gradient between the lower and upper surfaces of the sheet which, in some cases, may be sufficient to deform this sheet.

An object of the present invention is to provide a solution to this problem of sealing.

The invention accordingly provides an arrangement of the input and output ends of a machine for cooling sheets or like products, of the type comprising an upper frame and a lower frame, each of which frames comprises two lateral walls interconnected by a case defining an enclosure in which a cooling liquid circulates. According to the invention, there is provided at each end of the machine, on one hand, a sump for recovering or collecting the cooling liquid carried by the lower frame and extending throughout the width of the machine, and, on the other hand, means carried by the upper frame and arranged to project inwardly of the machine a fluid jet directed in counter-current fashion toward the liquid which tends to issue from the machine.

According to other features of the invention:

- the fluid collecting sump constitutes also a box structure which interconnects the two lateral walls of the lower frame;
- said means carried by the upper frame comprise a tank connected to a source of fluid and including in its lower part at least one aperture for projecting said fluid;
- the tank constitutes also a box-structure which interconnects the two lateral walls of the upper frame;
- the tank includes in its lower wall a slot which is downwardly inclined from the interior of the tank and through which slot the fluid is projected; preferably, this slot is inclined at an angle of 10° to 20° to the horizontal;
- the projected fluid is water.

The invention will be described in more detail hereinafter with reference to the accompanying drawing which is given solely by way of example and in which:

FIG. 1 is a longitudinal sectional view of an input end of a cooling machine according to the invention, and FIG. 2 is a top plan view on the line 2—2 of FIG. 1.

FIG. 1 shows the input end of a machine for cooling metal sheets and comprising an upper frame 10 and a lower frame 20. Each frame comprises lateral walls 11, 21 interconnected by metal cases 12, 22 which include roughly planar portions **12*a*, 22*a* which are parallel to the metal sheet which will pass through the machine, and curved portions 12*b*, 22*b* which surround the driving and guiding rolls 13, 23. The metal cases define an enclosure E in which circulates a cooling liquid, this enclosure being connected for this purpose to inlet and outlet conduits for this liquid, the conduits 14, 24** shown in the drawing being the outlet conduits.

Only the input end of the machine has been illustrated, but it will be understood that the output end of the machine is arranged in the same way at least in the essential aspects.

The input end of the machine is closed by retractable closing means in the form of one or more rigid shutters 30 which move roughly vertically, ie. perpendicularly to the direction of the travel of the sheet through the machine. These shutters, which are guided relative to the upper frame, cooperate by their lower edge with the lower frame and are shifted by fluid motors or cylinder devices 31.

A box-structure beam 32 constituting a fluid tank is disposed between the two lateral walls 11 of the upper frame. This beam improves the stiffness of the machine and is connected in its upper part to a source of fluid which, in the presently described embodiment, may be water. The lower wall 33 of this tank, located in the extension of the planar horizontal wall **12*a* of the upper frame, is fixed to this wall by any suitable means and defines a slot 34 which is inclined to the horizontal so as to project or direct a thin sheet of water toward the interior of the machine. The inclination of the slot to the horizontal is between 10° and 20°, and preferably of the order of 15°. The width of the slot 34 between the walls defining it may be of the order of 1 to 3 mm. It is longitudinally sub-divided into a number of sections by intermediate webs or partition walls 35 which constitute braces between the two longitudinally extending walls of the slot. Preferably, the box-structure 32 has a wall 36** which is inclined as for example 45° in order to guide, if required, the product entering the machine.

A collecting or recovery sump 40 is provided in the lower part of the machine and defined by a box-structure which interconnects the two lateral walls 21 of the lower frame of the machine and whose upper wall is, in the presently-described embodiment, formed by the horizontal wall **22*a* of the case. This box-structure includes an opening 41 of relatively large size and extending throughout the width of the machine and also extending to the vicinity of the closing shutter 30. The opening 41 is preferably covered with a grate 41*a*. In its lower part, this box-structure is connected to discharge conduits 42** for discharging the collected liquid.

With the machine closed and full of cooling liquid, the supply of water from the upper tank 32 may be cut off. The residual leakages which may occur if the screen formed by the shutters 30 is not exactly fluidtight, are collected in the sump 40 and discharged.

When a metal sheet must enter the machine, the tank 32 is supplied with water and projects a jet of water which is roughly planar and its speed may be of the order of 4 to 6 m/sec. This jet is directed toward the interior of the machine at an angle which, as mentioned before, may be of the order of 10° to 20°. When the closing shutters 30 are raised to allow the passage of the metal sheet, this water jet tends to oppose the outward flow of the cooling liquid contained in the machine. Further, as it has a vertical component, it urges this cooling liquid downwardly and the liquid is consequently more effectively collected in the sump 40.

During the passage of the sheet, the jet continues to perform this function, but the water is then discharged toward the sides of the machine, this function being still further improved owing to the orientation of deflectors 35.

On each side of the sheet, throughout the width of the input aperture which is not closed by the shutters, the jet of water projected by the tank 32 performs the same function as above and opposes the flow of the cooling liquid contained in the machine by urging it back toward the collecting sump.

It will be understood that similar functions are performed at the output end of the machine, so that the objects of the invention are achieved, namely: avoid any leakages at the input and output ends of the machine and avoid the presence of water on the upper surface of the sheet. Note also that these results are obtained by very simple, very reliable, cheap and particularly small means.

Having now described our invention what we claim as new and desire to secure by Letters Patent is:

1. A machine for cooling metal sheets or like products, which machine comprises an upper frame and a lower frame, each of said frames comprising two lateral walls and case means interconnecting the two walls and defining an enclosure having an input end and an output end for receiving a cooling liquid circulating therein, said enclosure having means defining a lower surface over which surface said sheet travels through the machine, and the machine further comprising, adjacent said input end and adjacent said output end, a sump for collecting the cooling liquid and carried by the lower frame and having a liquid receiving opening extending throughout the width of said enclosure and located substantially at the level of said surface of said enclosure, liquid projecting means carried by the upper frame and liquid contained in said projecting means, the liquid projecting, means having outlet means oreinted at 10°−20° to the horizontal from the projecting means downwardly toward said enclosure so as to project a jet of liquid in a downwardly inclined direction toward the interior of said enclosure so that said jet is directed in counter-current fashion against the cooling liquid in said enclosure which tends to issue from said enclosure, said sump opening being located substantially vertically below said outlet means of said liquid projecting means.

2. A machine according to claim 1, wherein the collecting sump also constitutes a box-structure which interconnects the two lateral walls of the lower frame.

3. A machine according to claim 1, wherein the sump includes an upper wall comprising a planar portion of said case means.

4. A machine according to claim 1, wherein said fluid projecting means comprise a tank for connection to a source of liquid and having in a lower part at least one aperture for projecting said jet of liquid.

5. A machine according to claim 4, wherein the tank also constitutes a box-structure which interconnects the two lateral walls of the upper frame.

6. A machine according to claim 4, wherein said aperture of the tank is a slot which is downwardly inclined from the interior of the tank toward the adjacent end of said enclosure.

7. A machine according to any one of the claims 1 to 4, wherein said upper opening of said sump is covered with grate means.

8. A machine according to claim 1, further comprising retractable enclosure closing means for said enclosure located at said input end and said output end in combination with and on a side of the respective liquid projecting means and sump adjacent to said enclosure.

* * * * *